US006000248A

United States Patent [19]

Erickson et al.

[11] Patent Number: 6,000,248

[45] Date of Patent: Dec. 14, 1999

[54] DOOR VENT FOR HORIZONTAL AXIS WASHING MACHINES

[75] Inventors: Donald E. Erickson; William A. Jensen, both of Newton; Evan R. Vande Haar, Pella, all of Iowa

[73] Assignee: Maytag Corporation, Newton, Iowa

[21] Appl. No.: 09/135,388

[22] Filed: Aug. 17, 1998

[51] Int. Cl.[6] ..... D06F 39/02; D06F 39/14

[52] U.S. Cl. ..... 68/17 R; 34/235; 68/20; 68/139; 68/196

[58] Field of Search ..... 68/3 R, 17 R, 68/18 R, 20, 139, 196; 34/235; 134/93, 95.2, 99.2; 312/213; 220/367.1, 368, 369, 370, 371, 372, 373, 374, 745, 747, 748

[56] References Cited

U.S. PATENT DOCUMENTS 848,618 4/1907 Anson ..... 220/373 X 3,647,354 3/1972 Loeb ..... 68/20 X 4,516,686 5/1985 Chaussepied ..... 220/367 X

FOREIGN PATENT DOCUMENTS 2148127 3/1973 Germany ..... 68/20

*Primary Examiner*—Philip R. Coe

*Attorney, Agent, or Firm*—Zarley, McKee, Thomte, Voorhees & Sease

[57] ABSTRACT

The door vent of the present invention includes an elongated tube mounted in a lower wall of the door of a horizontal axis washing machine, providing fluid communication between the interior chamber of the door and the interior of the tub, when the door is in a closed position. The tube projects upwardly within the door to form a standpipe, to prevent water from entering and becoming trapped within the door. A fine mesh screen is mounted in the vent to prevent suds from entering the door. A fan may be mounted to a compartment on the detergent receptacle on the washing machine housing, to draw air through the fluid dispensing system and out into the housing of the washing machine.

16 Claims, 3 Drawing Sheets

DOOR VENT FOR HORIZONTAL AXIS WASHING MACHINES

BACKGROUND OF THE INVENTION

The present invention relates generally to horizontal axis washing machines, and more particularly to a vent for the door of such washing machines, to allow air circulation through the machine when not in use.

Horizontal axis washing machines need some form of venting to allow air circulation when the machine is not in use. If this air exchange is not allowed, the tub may develop odors.

The vent should be located so as to permit the transfer of high humidity air outside of the main enclosure of the machine.

It is therefore a general object of the present invention to provide an improved horizontal axis washing machine with a door vent to permit air circulation.

Another object is to provide a door vent for a washing machine which prevents water and suds from becoming entrapped within the door.

A further object of the present invention is to provide a door vent for a horizontal axis washing machine which is simple to install, economical to manufacture and efficient in operation.

These and other objects will be apparent to those skilled in the art.

SUMMARY OF THE INVENTION

The door vent of the present invention includes an elongated tube mounted in a lower wall of the door of a horizontal axis washing machine, providing fluid communication between the interior chamber of the door and the interior of the tub, when the door is in a closed position. The tube projects upwardly within the door forming a standpipe, to prevent water from entering and becoming trapped within the door. A fine mesh screen is mounted in the vent to prevent suds from entering the door. An aperture is provided in a compartment of the detergent/additive dispensing receptacle on the washing machine housing, to allow airflow through the door vent, through the tub and the dispensing system and out into the housing of the washing machine. A fan may be mounted adjacent the aperture to assist in drawing air through the washing machine.

DETAILED DESCRIPTION OF THE PREFERRED EMBODIMENT

Figure 1:
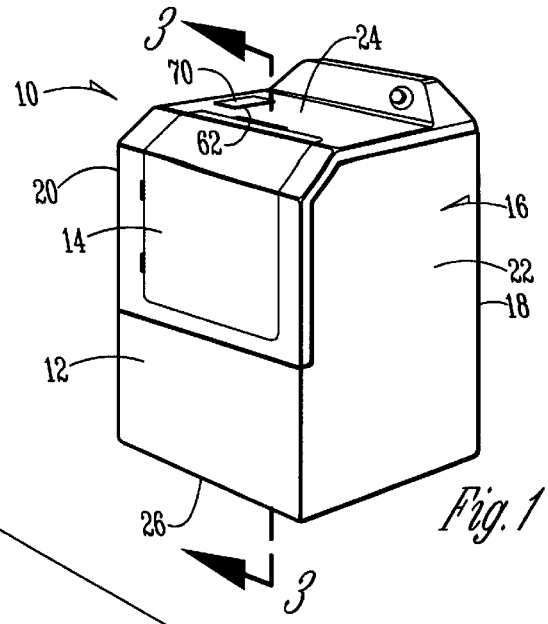
FIG. 1 is a perspective view of a horizontal axis washing machine which includes the door vent of the present invention.

Referring to FIG. 1, a horizontal axis washing machine is designated generally at 10, and includes the door vent of the present invention. Washing machine 10 includes a forward wall 12 with an operable door 14 mounted therein. The machine cabinet 16 further includes a rearward wall 18, side walls 20 and 22, and upper and lower walls 24 and 26.

Figure 2:
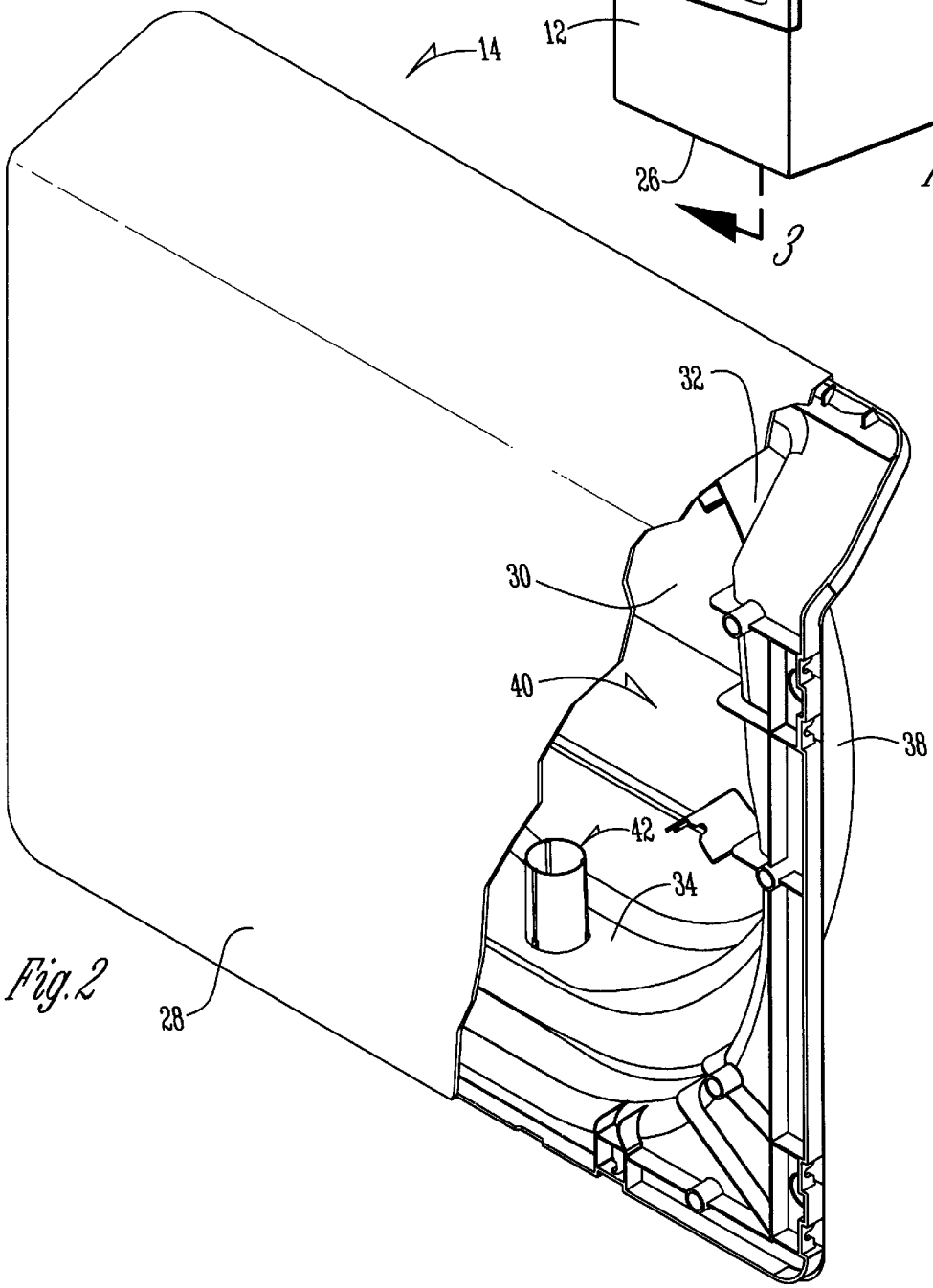
FIG. 2 is an enlarged perspective view of the washing machine door, with a portion broken away to show the interior thereof.

Referring now to FIG. 2, washing machine door 14 includes generally vertical outer and inner walls 28 and 30, opposing curved upper and lower walls 32 and 34, and opposing generally vertical side wall 38, all forming an enclosed chamber 40 within door 14. Chamber 40 is not air tight, and air from outside washing machine 10 may enter chamber 40 through various seams in the walls of door 14.

The door vent of the present invention is designated generally at 42, and is shown mounted in the lower wall 34 of door 14.

Figure 3:
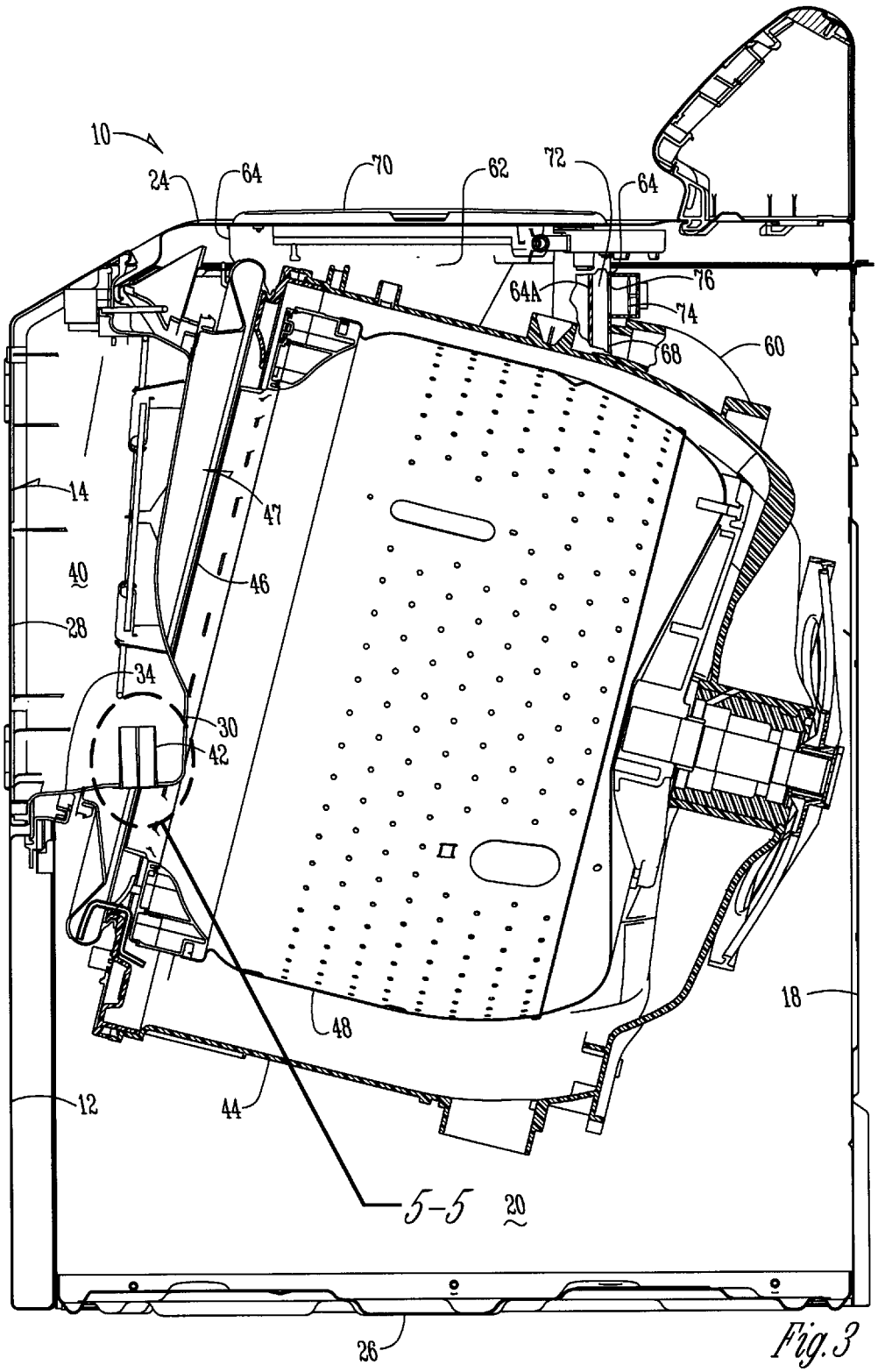
FIG. 3 is an enlarged side elevational view of the washing machine, with portions broken away to show components of the vent system of the present invention.

Referring now to FIG. 3, the washing machine 10 includes a generally horizontal axis imperforate outer tub 44 therein and a perforate inner tub or spinner basket 48 having an open forwardly oriented opening 46. While washing machine 10 is referred to as a "horizontal" axis washing machine, the rotational axis may be slightly inclined from horizontal. Door 14 is formed with the inner wall 30 projecting rearwardly into opening 46, so that door 14 will selectively cover the opening of the spinner basket 48 when closed. A flexible door boot 47 is attached to door 14 and engages and seals around the front of tub 44 when door 14 is closed. Door 14 is formed with lower wall 34 protruding into the mouth 46 of spinner basket 48, to permit fluid communication between door vent 42 and the interior of tub 44 and spinner basket 48.

Figure 4A:
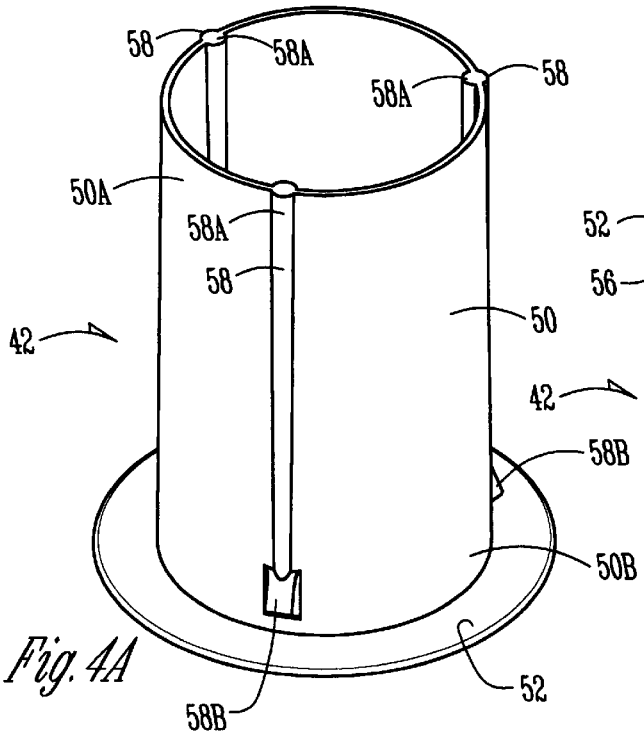
FIG. 4A is an enlarged perspective view of the vent tube, showing the upper end of the vent tube.
Figure 4B:
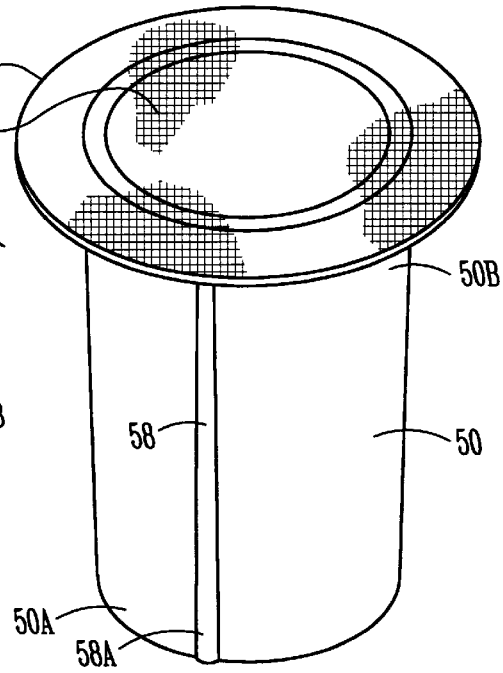
FIG. 4B is an enlarged perspective view of the vent tube, showing the lower end of the vent tube.
Figure 5:
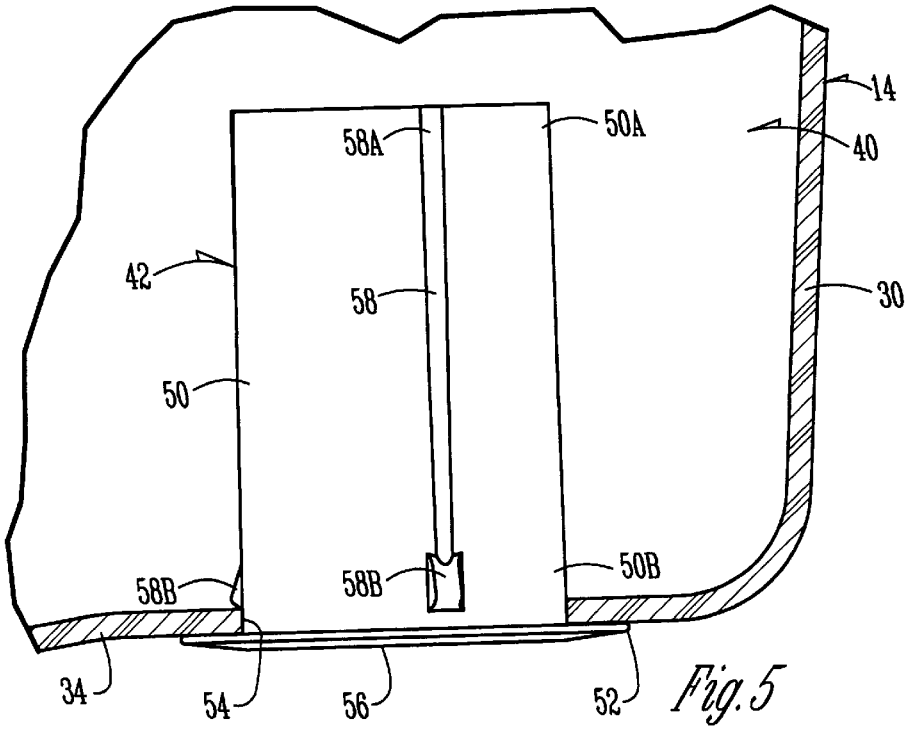
FIG. 5 is an enlarged sectional view of a portion of the washing machine door, showing a side elevational view of the door vent therein.

Referring now to FIGS. 4A, 4B, and 5, door vent 42 includes an elongated tube 50 having upper and lower ends 50*a* and 50*b* respectively. A flange 52 projects radially outwardly from the lower end 50*b* of tube 50.

As shown in FIG. 5, tube 50 extends through an aperture 54 in the lower wall 34, with flange 52 in sealing contact with the outer surface of lower wall 34, and the upper end 50*a* projecting vertically upwardly into the chamber 40 of door 14. The water and suds are retained within the vertical length of tube 50 to prevent being captured within door 14.

A fine mesh screen 56 is mounted across the opening of tube 50, with a mesh of a size permitting air flow therethrough, but generally preventing suds from passing therethrough. Preferably, the screen has a mesh size of 250 microns or less. Tube 50 is oriented vertically to act as a standpipe in the event that water or suds from the washing machine tub splash upwardly and enter vent 42 through mesh screen 56.

A plurality of radially projecting ridges 58 are formed on the exterior surface of tube 50 and extend longitudinally parallel to one another. Each ridge 58 has upper and lower ends 58*a* and 58*b*, with the lower ends of each ridge spaced from the flange 52 a distance less than the thickness of the door lower wall 34 to provide an interference seal of the flange 52 against the door lower wall 54. The ridge lower ends 58*b* project radially a distance greater than the diameter of the door lower wall aperture 54, so as to retain the door lower wall 34 between the flange 52 and the lower ends of ridges 58. Preferably, the lower end of each ridge 58 flares radially outwardly and downwardly such that the flared ends will be compressed as the tube 50 is extended through aperture 54 in an upward direction. After passing through aperture 54, the flared ends of ridges 58 will expand radially outwardly to retain vent tube 50 in position on door 14.

Referring once again to FIG. 3, room air is free to enter chamber 40 through seams in door 14. Air within chamber 40 of door 14 will circulate through tub 44, and spinner basket 48 thereby providing an air vent for the washing machine. Because the door 14 is formed of a plurality of pieces connected together, natural air flow between the various pieces will permit natural air to enter into the chamber 40 of the door and thence into the interior of tub 44.

Air may then circulate out of tub 44 through a fluid conduit 60 which is in communication with (not shown) the interior of tub 44. Fluid conduit 60 is also in communication with the interior of a detergent/additive dispensing receptacle 62 in the upper wall 24 of cabinet 16. Receptacle 62 includes four generally vertical side walls 64 and a sloped bottom wall connected to the lower ends of the side walls 64. A drain opening 68 is formed at the lower end of the rearwardly sloped bottom of receptacle 62, and is in communication with the interior of conduit 60 to drain detergent or additives from receptacle 62 into tub 44. An operable door 70 selectively covers the open upper end of receptacle 62.

An air chamber 72 is located adjacent one side wall 64 and interior wall 64*a,* and is in fluid communication with conduit 60 through drain opening 68. An aperture or opening 76 is provided in wall 64 of the air chamber 72.

Natural convection airflow will occur through the door vent 42, the tub 44 and spinner basket 48, the fluid conduit 60 into air chamber 72 and out through opening 76 to the interior of the cabinet 16. This airflow path could also easily be extended to the exterior of the cabinet 16.

A fan 74 may be mounted over the opening 76 in a side wall of air chamber 72, and is operable to draw air from chamber 72 and exhaust the air either within the interior of cabinet 16 or exteriorly thereof.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

What is claimed is:

1. In combination:

a washing machine having a tub forming a tub chamber with an open mouth;

a door having a door housing forming a door compartment therein;

mechanism connecting said door to said washing machine for movement between a closed position covering said open mouth of said tub and an open position permitting access to said tub chamber; and a vent tube mounted in said door housing providing fluid communication between said door compartment and said tub chamber when said door is in said closed position.

2. The door vent of claim 1, further comprising an air permeable filter mounted within the vent tube.

3. A door vent for a washing machine of the type having a substantially horizontal axis tub with a forwardly projecting open mouth, comprising:

a door having opposing generally vertical outer and inner walls, opposing upper and lower walls, and opposing generally vertical side walls, the walls forming an enclosed chamber;

said door having means for connecting the door to the washing machine for movement between a closed position covering the mouth of the tub, and an open position permitting access to the interior of the tub from exterior of the machine; and a vent tube mounted in the door lower wall providing fluid communication between the chamber and the interior of the tub when the door is in the closed position.

4. The door vent of claim 3, further comprising an air permeable filter mounted within the vent tube.

5. The door vent of claim 4, wherein the filter is a fine mesh screen having openings of a size of 250 microns or less.

6. A washing machine, comprising:

an air permeable, enclosed cabinet having upper and lower walls, forward and rearward walls and opposing side walls, the walls defining an interior cavity;

a tub mounted within the cavity and oriented generally horizontally, with a forwardly oriented open mouth;

the cabinet forward wall having an opening formed therein permitting access to the interior of the tub from the exterior of the cabinet;

a door mounted on the cabinet for selectively closing the opening, the door having opposing generally vertical outer and inner walls, opposing upper and lower walls, and opposing generally vertical side walls, the walls forming an enclosed chamber; and a vent tube mounted in the door lower wall, providing fluid communication between the chamber and the interior of the tub when the door is in a closed position.

7. A washing machine according to claim 6 and further comprising an air permeable filter mounted within the vent tube.

8. The washing machine of claim 7, wherein the filter is a fine mesh screen having openings of a size of 250 microns or less.

9. The washing machine of claim 6, wherein the vent tube is oriented generally vertically, with upper and lower ends, and further comprising a flange mounted on the lower end projecting radially outwardly from the tube, the tube extending through an aperture in the door lower wall with the flange having an outer diameter greater than the aperture and in contact with an exterior surface of the door, and the tube upper end projecting within the door chamber.

10. The washing machine of claim 9, wherein said tube further includes a plurality of radially projecting ridges extending longitudinally along the tube exterior surface, each ridge having an upper and lower end, the lower end of each ridge spaced from the flange a distance less than a thickness of the door lower wall, the ridge lower ends projecting radially a distance greater than the diameter of the aperture, to retain the door lower wall between the flange and the ridge lower ends.

11. The washing machine of claim 10, wherein each ridge lower end flares radially outwardly from the ridge.

12. The washing machine of claim 10, wherein the screen has openings of approximately 250 microns or less.

13. The washing machine of claim 9, further comprising a fine mesh screen extending across the interior of the tube, having mesh openings of a size permitting air flow but substantially preventing liquid from passing therethrough.

14. The washing machine of claim 6, wherein the washing machine includes a dispensing apparatus for dispensing materials into the tub, the dispensing apparatus including:

a receptacle mounted in the cabinet for receiving liquid to be dispensed; and a conduit extending from the receptacle to the tub allowing air to flow from the dispensing apparatus and exhaust to the interior of the cabinet exteriorly of the tub after an operational cycle has been completed.

15. The washing machine of claim 14, and further including a fan operably mounted on the receptacle to assist in moving air through the interior of the tub and exhausting therefrom.

16. The washing machine of claim 15, wherein the receptacle includes:

four generally vertical side walls forming an open upper end;

a sloped bottom mounted on lower ends of the side walls;

a drain opening formed at a lower end of the sloped bottom, connected to the fluid conduit;

an operable door connected to one side wall for selectively closing the open upper end of the receptacle.

* * * * *